US005205873A

United States Patent [19]

Faure et al.

[11] Patent Number: 5,205,873

[45] Date of Patent: Apr. 27, 1993

[54] PROCESS FOR THE LOW PRESSURE CARBURIZATION OF METAL ALLOY PARTS

[75] Inventors: André Faure, Colombes; Jacques Frey, Lamorlaye, both of France

[73] Assignee: Acieries Aubert & Duval, Neuilly Sue Seine, France

[21] Appl. No.: 724,134

[22] Filed: Jul. 1, 1991

[30] Foreign Application Priority Data

Jul. 2, 1990 [FR] France ..... 90 08330

[51] Int. Cl.[5] ..... C21D 9/00

[52] U.S. Cl. ..... 148/206; 148/216; 148/223

[58] Field of Search ..... 148/206, 216, 223

[56] References Cited

U.S. PATENT DOCUMENTS 4,108,693 8/1978 L'Hermite et al. ..... 148/16.5
4,152,177 5/1979 Mantel et al. ..... 148/16.5
4,836,684 6/1989 Murakami et al. ..... 148/16.5

FOREIGN PATENT DOCUMENTS 1559690 1/1980 United Kingdom .

OTHER PUBLICATIONS

Chemical Abstracts, vol. 97, No. 14, Oct. 1982, p. 212, Abstract No. 113319g, Columbus, Ohio; J. H. Kaspersma et al.

Chemical Abstracts, vol. 91, No. 18, Oct. 1979, p. 218, Abstract No. 144330j, Columbus, Ohio; V. S. Krylov et al.

Advanced Materials & Processes, vol. 137, No. 3, Mar. 1990, pp. 41–44, 47–48, Materials Park, Ohio, E. J. Kubel, Jr., et al.

*Primary Examiner*—Upendra Roy

*Attorney, Agent, or Firm*—Pearne, Gordon, McCoy & Granger

[57] ABSTRACT

A low pressure carburization process for metal alloy parts uses a fuel mixture consisting of hydrogen with 2 to 60% by volume ethylene. The fuel mixture is heated to a temperature between 820° and 1100° C. A furnace installation for carrying out the process includes a double vacuum tank or vessel arrangement with internal carburizing gas distribution, an annular space surrounding the vessel, a cover, thermocouples and a microcomputer control arrangement.

10 Claims, 15 Drawing Sheets

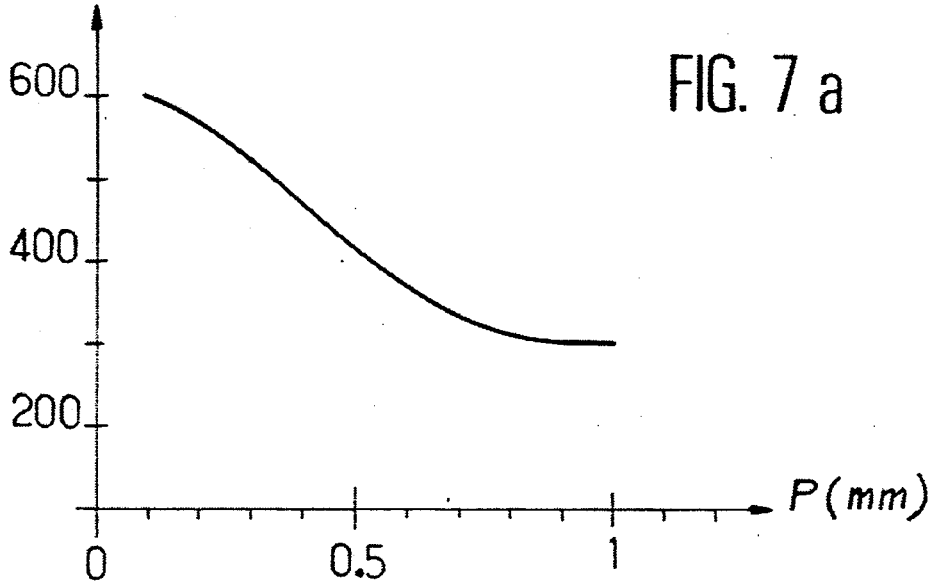
FIG. 7 a
FIG. 7 b
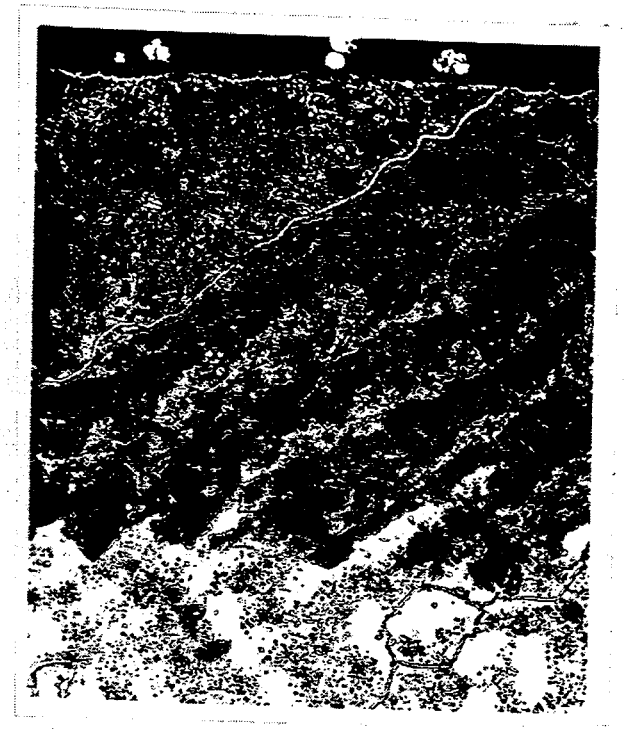

PROCESS FOR THE LOW PRESSURE CARBURIZATION OF METAL ALLOY PARTS

BACKGROUND OF THE INVENTION AND RELATED ART

The present invention relates to a low pressure carburization process applied to metal alloy parts and more particularly steel parts, as well as to an installation permitting the performance of said process.

Carburization is widely used in metallurgy, when it is a matter of hardening the surface of metal parts over a certain depth, while excluding the internal portions thereof, which must retain a certain flexibility so as not to inopportunely break. According to a standard metallurgical process carbon is incorporated by gaseous carburization.

As is more particularly described in the Hayes French Patent 2 154 398, the articles to be carburized are placed in a vacuum furnace, in which circulation takes place of gaseous hydrocarbons essentially based on methane or propane and treatment only takes place at temperatures above approximately 950° C. Working takes place at a pressure below atmospheric pressure. This ensures the absorption and thermal diffusion of the carbon on the surface of the article. It should be noted that the performance of this process involves the need to use a pulsation effect for diffusing the carbon to the desired depth in the treated part.

According to a process described in the Ipsen Patent 2 361 476, use is also made of a methane-based fuel gas. The latter suffers from the disadvantage of dissociating, while producing a large amount of carbon, which is transformed into lampblack and hinders carburization by dirtying the treated parts and also the furnace.

Other furnace designers still use a vacuum plasma discharge to attempt to obviate the difficulties inherent in the use of the aforementioned hydrocarbons and this is known as ionic carburization.

SUMMARY OF THE INVENTION

The aim of the present invention is to eliminate such disadvantages by carrying out a process where use is made of a fuel mixture constituted by hydrogen and ethylene with 2 to 60% by volume ethylene and the furnace is heated at between approximately 820 and approximately 1100° C., as a function of the nature of the metals forming the parts and as a function of the desired content and depth of the carbon on the surface of the parts.

The process according to the invention is particularly suitable for the treatment of parts used in advanced industries and in the car industry such as bearings, gears, slide bars, cams, piston rods, etc.

As a result of this process, it is possible to carburize all the alloys treated by the presently known processes, but under better quality and usually speed conditions. It is also possible to treat certain alloys, whose naturally very passive surface has hitherto required a prior depassivation treatment. Other alloys which could not be treated, even after depassivation, can be treated as a result of the inventive process.

More specifically, the process according to the invention essentially comprises the following stages:

a) forming a preliminary vacuum in the furnace vessel to a pressure of $10^{-1}$ hPa so as to eliminate the air, b) filling the vessel with purified nitrogen at atmospheric pressure, c) loading the vessel containing the metal parts, d) placing the vessel under a vacuum at $10^{-2}$ hPa, e) heating to the austenitization temperature and maintaining at this temperature for homogenizing the parts, f) introducing hydrogen up to 500 hPa, g) carbonization by introducing ethylene-based fuel gas at a pressure of 10 to 100 hPa, as a function of the particular case, h) vacuum diffusion at $10^{-1}$ hPa and i) introduction of nitrogen for unloading.

The performance of the process involves the use of a particular device, whose characteristics will be given hereinafter. This device, described in the case of a double vacuum furnace, is also usable in a cold wall furnace.

BRIEF DESCRIPTION OF THE DRAWINGS

Other advantages and features of the invention can be gathered from the following description of several non-limitative embodiments of the carburization of different alloys and with reference to the attached drawings, wherein show:

FIGS. 7*a* and 7*b* relate to example 7 concerning the carburization of Co:KC 20 WN-based superalloy parts.

Figure 1A:
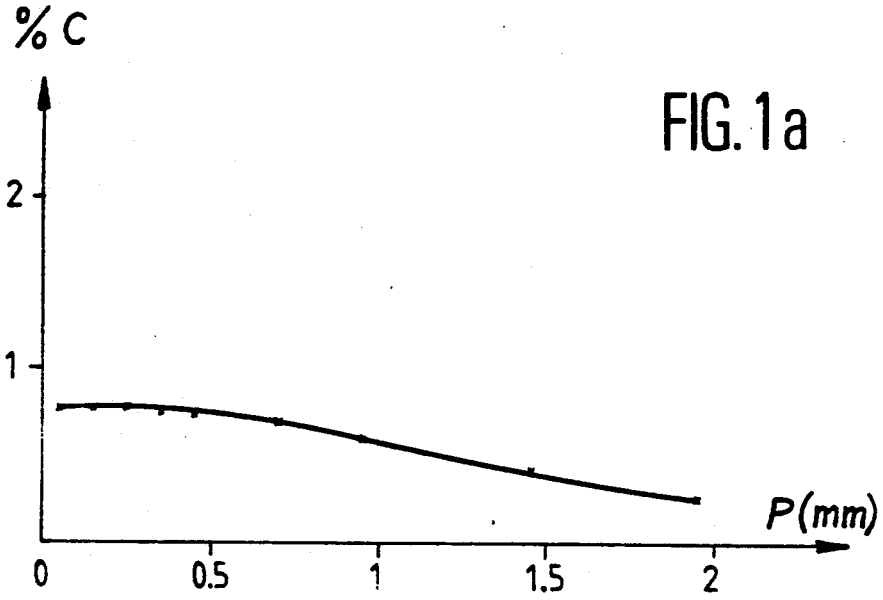
FIGS. 1*a*, 1*b*, 1*c* and 1*d* relating to example 1 dealing with the carburization of 16 NCD 13 steel parts over the standard depth of 1.80 mm.
Figure 1B:
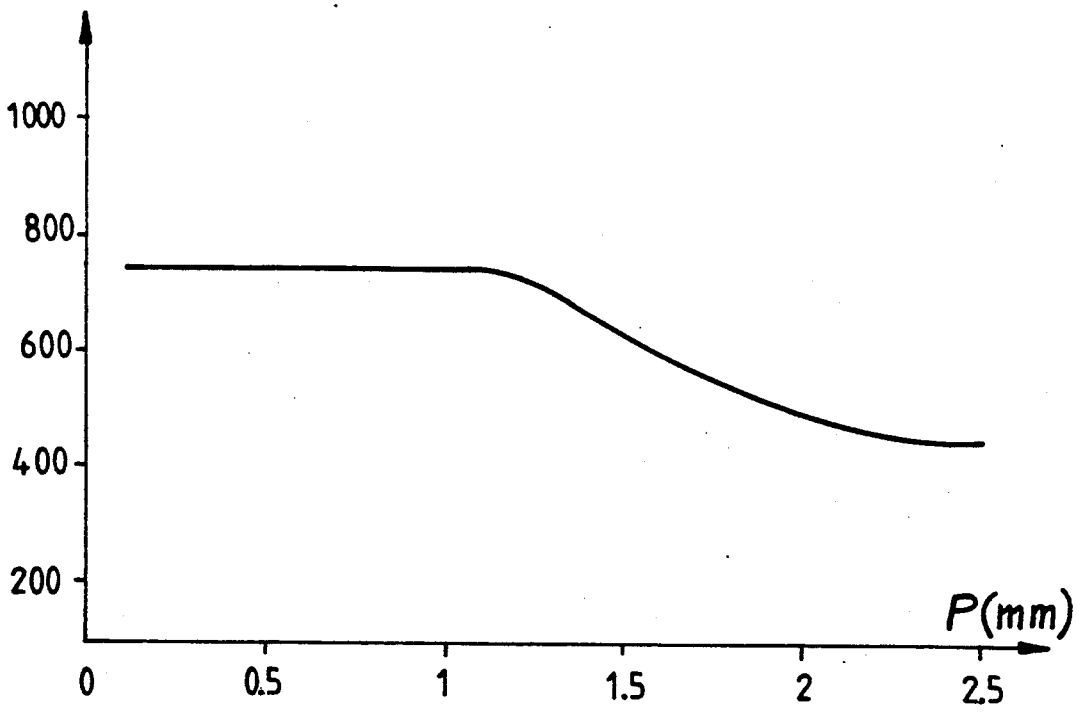

To facilitate the understanding of the seven following examples, certain basic details are given.

DESCRIPTION OF THE PREFERRED EMBODIMENTS

THE COMPOSITION OF THE METAL ALLOYS UNDERGOING CARBURIZATION

| | Percentage by weight | | | | | | |
|---|---|---|---|---|---|---|---|
| AFNOR Standard | C | Ni | Cr | Mo | W | V | Co |
| 16 NCD 13 Steel | 0.16 | 3.2 | 1 | 0.25 | | | |
| 14 NC 12 Steel | 0.14 | 3 | 0.75 | | | | |
| Z 15 CN 17.03 Steel | 0.15 | 3 | 17 | | | | |
| Z 20 WC 10 Steel | 0.20 | | 3 | | 10 | | |
| Z 38 CDV 5 Steel | 0.38 | | 5 | 1.3 | | 0.4 | |
| XC 20 WN Alloy | 0.10 | 10 | 20 | | 15 | | Remainder |

Use of Carburized Metal Alloys

16 NCD 13 Steel: gears, hubs, shafts, bearing races, aeronautical safety parts in general.

14 NC 12 Steel: gears, hubs, shafts, etc.

Z 15 CN 17.03 Steel: stainless bearing races, integrated stainless roller track parts (aeronautics).

Z 20 WC 10 Steel: detachable or loose roller tracks for hot use (aeronautics).

Z 38 CDV 5 Steel: tool parts in general, e.g. dies, punches and moulds.

Cobalt KC 20 WN-based superalloy: gas turbine parts in general.

Compositions of reagents used for microetching:

Nital: Nitric acid d=1.38:2% ethyl alcohol.

Italien: Hydrochloric acid 80 ml, acetic acid 48 ml, crystallized picric acid 12 g and ethyl alcohol 800 ml.

Dichromate: Sulphuric acid 10 ml, potassium dichromate 10 g and demineralized water 1000 ml.

EXAMPLE 1: Depth 1.80 mm (16 NCD 13 Steel).

Experimental Conditions.
Carburization at 980° C.
(phases 1 to 5 chronological order)

| | |
|---|---|
| 1) Austenitization (980° C.) | |
| Maximum vacuum: | $10^{-2}$ hPa |
| Maintained for: | 30 min. |
| 2) Breaking the vacuum with hydrogen (980° C.) | |
| Absolute pressure: | 500 hPa |
| Not maintained | |
| 3) Carbonization (980° C.) | |
| Absolute pressure: | 35 hPa |
| Maintained for: | 2 h |
| Ethylene fuel gas: | 130 l/h (at atm.p) |
| % residual ethylene in evacuated gas: | 7 |
| 4) Diffusion (980° C.) | |
| Absolute pressure: | $\leqq 10^{-1}$ hPa |
| Maintained for: | 3½ h |
| 5) Breaking vacuum with nitrogen at atm.p | |

Use Treatment.

Austenitization at 825° C.
in vacuo
Oil hardening
Tempering at 140° C.

EXAMPLE 2: Blend and open bores, 14 NC 12 Steel.

Experimental Conditions.
Carburization at 880° C.
(phases 1 to 5 in chronological order)

| | |
|---|---|
| 1) Austenitization (880° C.) | |
| Maximum vacuum: | $10^{-2}$ hPa |
| Maintained for: | 30 min. |
| 2) Breaking the vacuum with hydrogen (880° C.) | |
| Absolute pressure: | 500 hPa |
| Not maintained | |
| 3) Carbonization (880° C.) | |
| Absolute pressure: | 30 hPa |
| Maintained for: | 85 min |
| Ethylene fuel gas: | 145 l/h (at atm.p) |
| % residual ethylene in evacuated gas: | 20 |
| 4) Diffusion (880° C.) | |
| Absolute pressure: | $\leqq 10^{-1}$ hPa |
| Maintained for: | 20 min. |
| 5) Breaking vacuum with nitrogen at atm.p | |

Use Treatment

Austenitization at 825° C.
in vacuo
Oil hardening
Tempering at 140° C.

EXAMPLE 3: Depth 0.25 mm (16 NCD 13 Steel).

Experimental Conditions.

-continued

Carburization at 820° C.
(phases 1 to 5 in chronological order)

| | |
|---|---|
| 1) Austenitization (820° C.) | |
| Maximum vacuum: | $10^{-2}$ hPa |
| Maintained for: | 30 min. |
| 2) Breaking the vacuum with hydrogen (820° C.) | |
| Absolute pressure: | 500 hPa |
| Not maintained | |
| 3) Carbonization (820° C.) | |
| Absolute pressure: | 25 hPa |
| Maintained for: | 1 h |
| Ethylene fuel gas: | 150 l/h (at atm.p) |
| % residual ethylene in evacuated gas: | 30 |
| 4) Diffusion (none) | |
| 5) Breaking vacuum with nitrogen at atm.p | |

Use Treatment

Austenitization at 820° C.
in vacuo
Oil hardening
Tempering at 140° C.

EXAMPLE 4: Z 15 CN 17.03 Steel

Experimental Conditions.
Carburization at 980° C.
(phases 1 to 8 in chronological order)

| | |
|---|---|
| 1) Austenitization (1020° C.) | |
| Maximum vacuum: | $10^{-2}$ hPa |
| Maintained for: | 30 min. |
| Cooling in furnace to: | 980° C. |
| 2) Breaking vacuum with hydrogen (980° C.) | |
| Absolute pressure: | 500 hPa |
| Not maintained | |
| 3) Carbonization (980° C.) | |
| Absolute pressure: | 35 hPa |
| Maintained for: | 45 min. |
| Ethylene fuel gas: | 135 l/h (at atm.p) |
| % residual ethylene in evacuated gas: | 8 |
| 4) Diffusion (980° C.) | |
| Absolute pressure: | $\leqq 10^{-1}$ hPa |
| Maintained for: | 10 min. |
| 5) Breaking vacuum with hydrogen (980° C.) | |
| Absolute pressure: | 500 hPa |
| Not maintained | |
| 6) Carbonization (980° C.) | |
| Absolute pressure: | 35 hPa |
| Maintained for: | 6¾ h |
| Ethylene fuel gas: | 135 l/h (at atm.p) |
| % residual ethylene in evacuated gas: | 8 |
| 7) Diffusion (980° C.) | |
| Absolute pressure: | $< 10^{-1}$ HPa |
| Maintained for: | 4¾ h |
| 8) Breaking vacuum with nitrogen at atm.p | |

Use Treatment

Austenitization at 1020° C.
in vacuo
Oil hardening
Passing to cold −75° C.
Tempering at 250° C.

EXAMPLE 5: Z 20 WC 10 Steel

Experimental Conditions.
Carburization at 940° C.
(phases 1 to 8 in chronological order)

| | |
|---|---|
| 1) Austenitization at 1010° C. | |
| Maximum vacuum: | $10^{-2}$ hPa |
| Maintained for: | 30 min. |
| Cooling in furnace to: | 940° C. |
| 2) Breaking vacuum with hydrogen (940° C.) | |
| Absolute pressure: | 500 hPa |
| Not maintained | |
| 3) Carbonization (940° C.) | |
| Absolute pressure: | 30 hPa |
| Maintained for: | 45 min. |

-continued

| | |
|---|---|
| Ethylene fuel gas: | 140 l/h (at atm.p) |
| % residual ethylene in evacuated gas: | 10 |
| 4) Diffusion (940° C.) | |
| Absolute pressure: | $\leqq 10^{-1}$ hPa |
| Maintained for: | 10 min. |
| 5) Breaking vacuum with hydrogen (940° C.) | |
| Absolute pressure: | 500 hPa |
| Not maintained | |
| 6) Carbonization (940° C.) | |
| Absolute pressure: | 30 hPa |
| Maintained for: | 1¼ h |
| Ethylene fuel gas: | 140 l/h (at atm.p) |
| % residual ethylene in evacuated gas: | 10 |
| 7) Diffusion (none) | |
| 8) Breaking vacuum with nitrogen at atm.p | |

Use Treatment

Austenitization at 1100° C.
in vacuo
Hardening with neutral gas
Passage to cold −75° C.
First tempering at 560° C.
Second tempering at 560° C.

EXAMPLE 6: Z 38 CDV 5 Steel

Experimental Conditions.
Carburization at 960° C.
(phases 1 to 8 in chronological order)

| | |
|---|---|
| 1) Austenitization (980° C.) | |
| Maximum vacuum: | $10^{-2}$ hPa |
| Maintained for: | 30 min. |
| Cooling in furnace to: | 960° C. |
| 2) Breaking the vacuum with hydrogen (960° C.) | |
| Absolute pressure: | 500 hPa |
| Not maintained | |
| 3) Carbonization (960° C.) | |
| Absolute pressure: | 30 hPa |
| Maintained for: | 30 min. |
| Ethylene fuel gas: | 135 l/h (at atm.p) |
| % residual ethylene in evacuated gas: | 9 |
| 4) Diffusion (960° C.) | |
| Absolute pressure: | $\leqq 10^{-1}$ hPa |
| Maintained for: | 10 min. |
| 5) Breaking vacuum with hydrogen (960° C.) | |
| Absolute pressure: | 500 hPa |
| Not maintained | |
| 6) Carbonization (960° C.) | |
| Absolute pressure: | 30 hPa |
| Maintained for: | 1 h |
| Ethylene fuel gas: | 135 h/l (at atm.p) |
| % residual ethylene in evacuated gas: | 9 |
| 7) Diffusion (960° C.) | |
| Absolute pressure: | $\leqq 10^{-1}$ hPa |
| Maintained for: | 2 h |
| 8) Breaking vacuum with nitrogen at atm.p | |

Use Treatment

Austenitization at 990° C.
in vacuo
Air hardening
Passage to cold −75° C.
Tempering at 200° C.

EXAMPLE 7: Co:KC 20 WN-based Superalloy

Experimental Conditions.
Carburization at 1100° C.
(phases 1 to 5 in chronological order)

| | |
|---|---|
| 1) Austenitization (1100° C.) | |
| Maximum vacuum: | $10^{-2}$ hPa |
| Maintained for: | 30 min. |
| 2) Breaking the vacuum with hydrogen (1100° C.) | |
| Absolute pressure: | 500 hPa |
| Not maintained | |
| 3) Carbonization (1100° C.) | |

-continued

| | |
|---|---|
| Absolute pressure: | 40 hPa |
| Maintained for: | 4 h |
| Ethylene fuel gas: | 150 l/h (at atm.p) |
| % residual ethylene in evacuated gas: | 3 |
| 4) Diffusion (1100° C.) | |
| Absolute pressure: | $\leqq 10^{-1}$ hPa |
| Maintained for: | 2 h |
| 5) Breaking vacuum with nitrogen at atm.p | |

FIG. 1*a* shows the carbon profile of a part carburized according to example 1 . It is possible to see the carbon percentage incorporated as a function of the depth P.

FIG. 1 shows the microhardness HV 0.5 kg as a function of the depth for parts treated according to example 1.

Figure 1C:
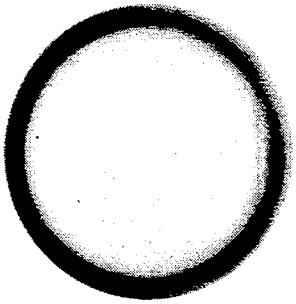
Figure 1D:
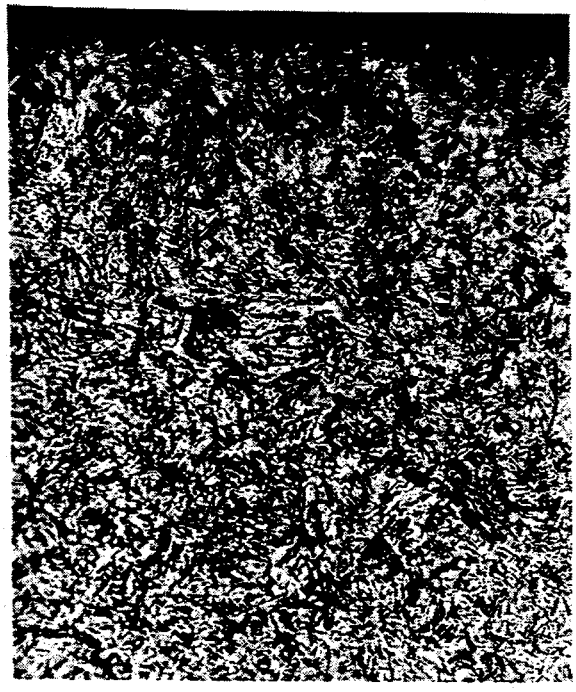

FIG. 1*c* is a section of a cylindrical part 10 surface carburized according to example 1 after 2% nital etching and respective magnification of 2 and 500 X revealing the great regularity of the macrograph and the structural homogeneity on the micrograph.

Examples 2 to 7 are illustrated in the same way as with respect to example 1.

Figure 2A:
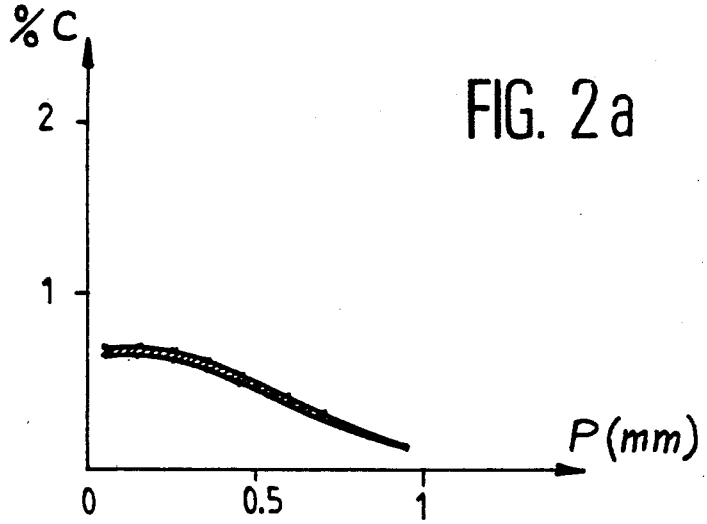
FIGS. 2*a*, 2*b*, 2*c* , 2*d*and 2*e* relate to example 2 concerning the carburization of parts having a difficult geometry and blind or open bores made from 14 NC 12 steel, FIG. 2*c* relating to example 2 being a diagram showing the arrangement of the parts during treatment.
Figure 2B:
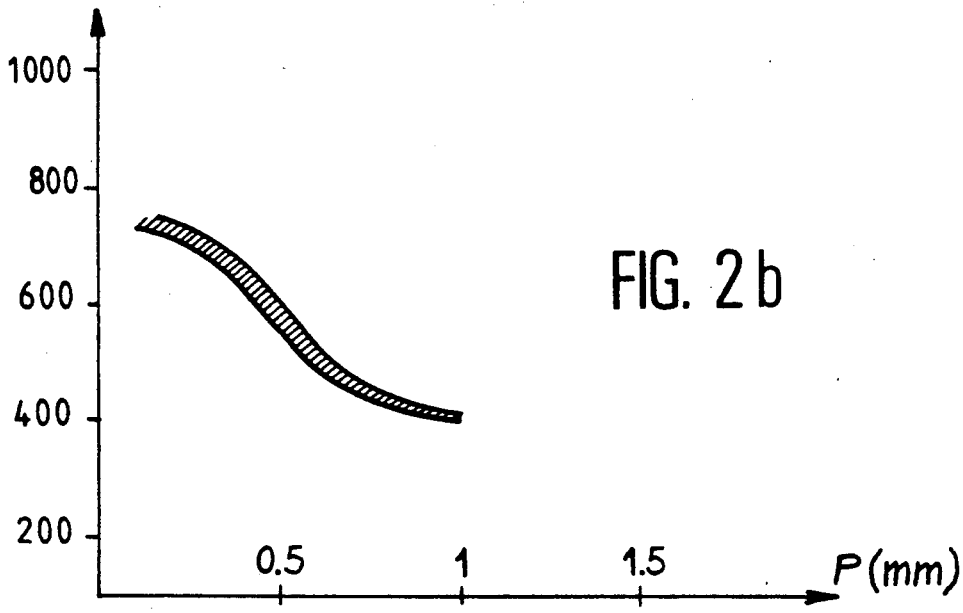
Figure 2C:
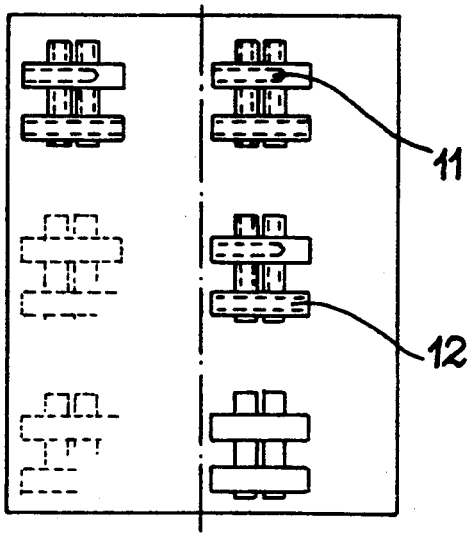

FIG. 2*c* shows the exploded view arrangement over three stages in the furnace vessel of blind bores 11 and open bores 12. Remarkable results were obtained by using tubes having a length of 85 mm, an external diameter of 14 mm and a bore diameter of 8 mm.

FIG. 2*a* shows the dispersion band of the carbon profiles obtained for the parts shown in FIG. 2*c*.

FIG. 2*b* shows the dispersion band of the microhardness profiles obtained for the parts in FIG. 2*c*.

Figure 2D:
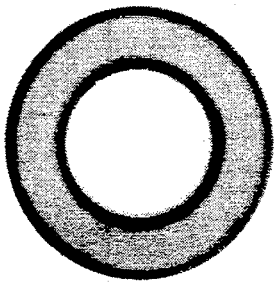
Figure 2E:
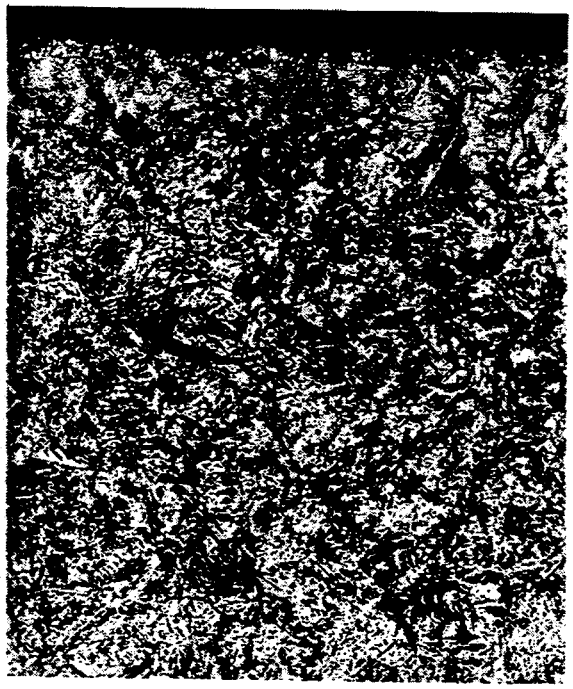
Figure 3A:
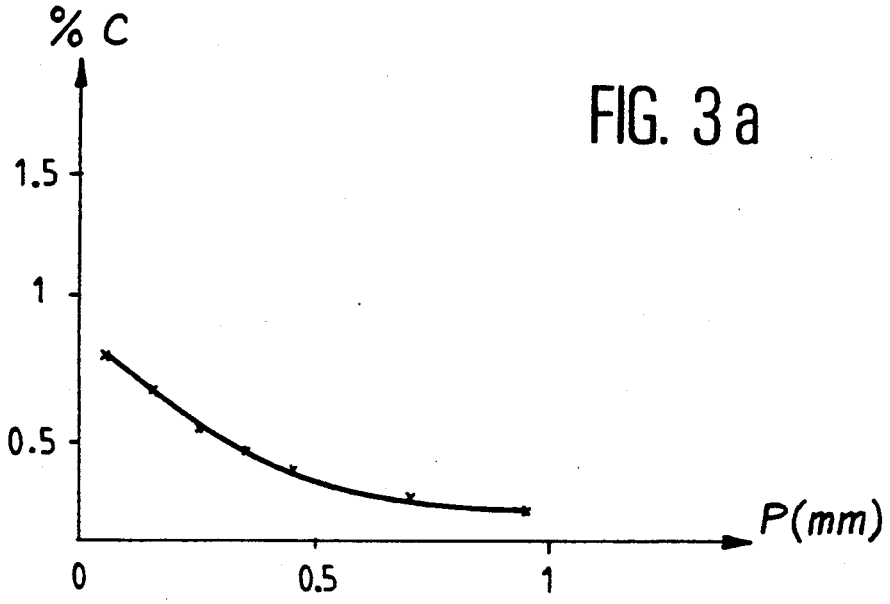
FIGS. 3*a*, 3*b*, 3*c* and 3*d* relate to example 3 concerning carburization of 16 NCD 13 steel parts over a very small depth of 0.25 mm.
Figure 3B:
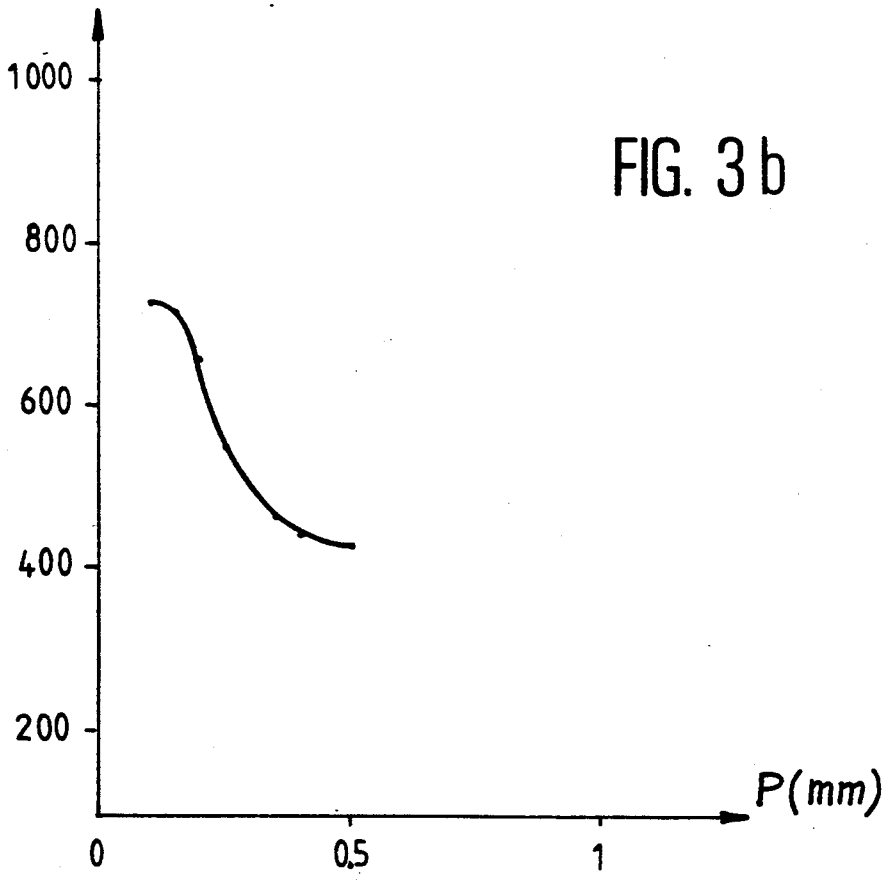
Figure 3C:
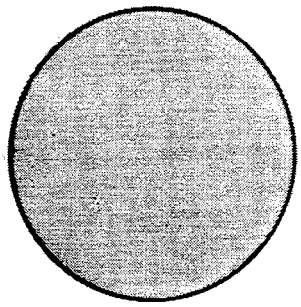
Figure 3D:
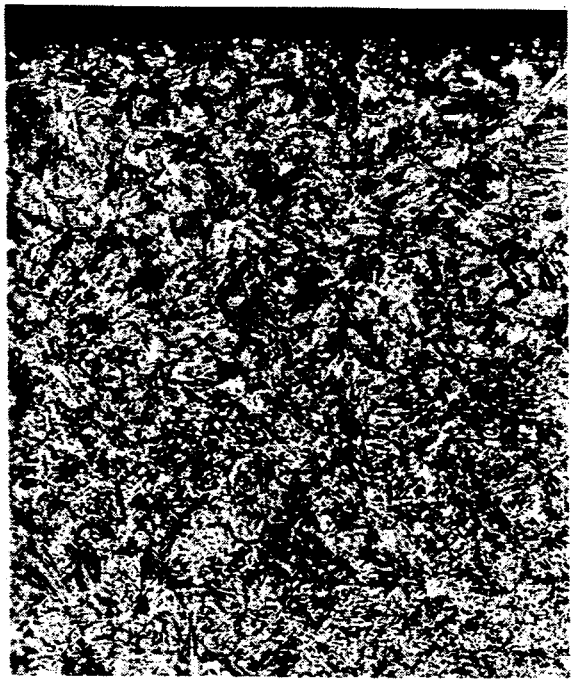
Figure 4A:
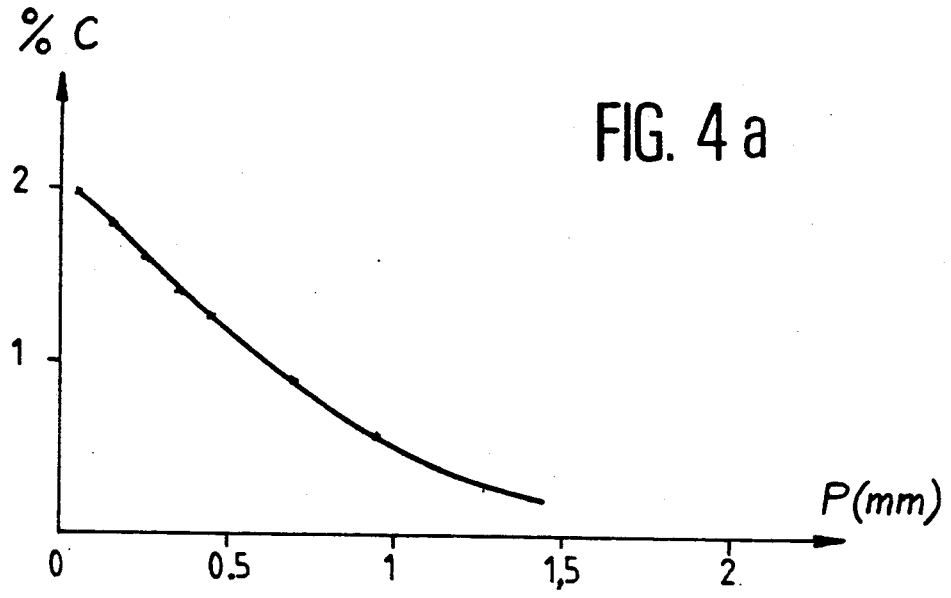
FIGS. 4*a*, 4*b*, 4*c* and 4*d* relate to example 4 concerning the carburization of Z 15 CN 17.03 steel parts.
Figure 4B:
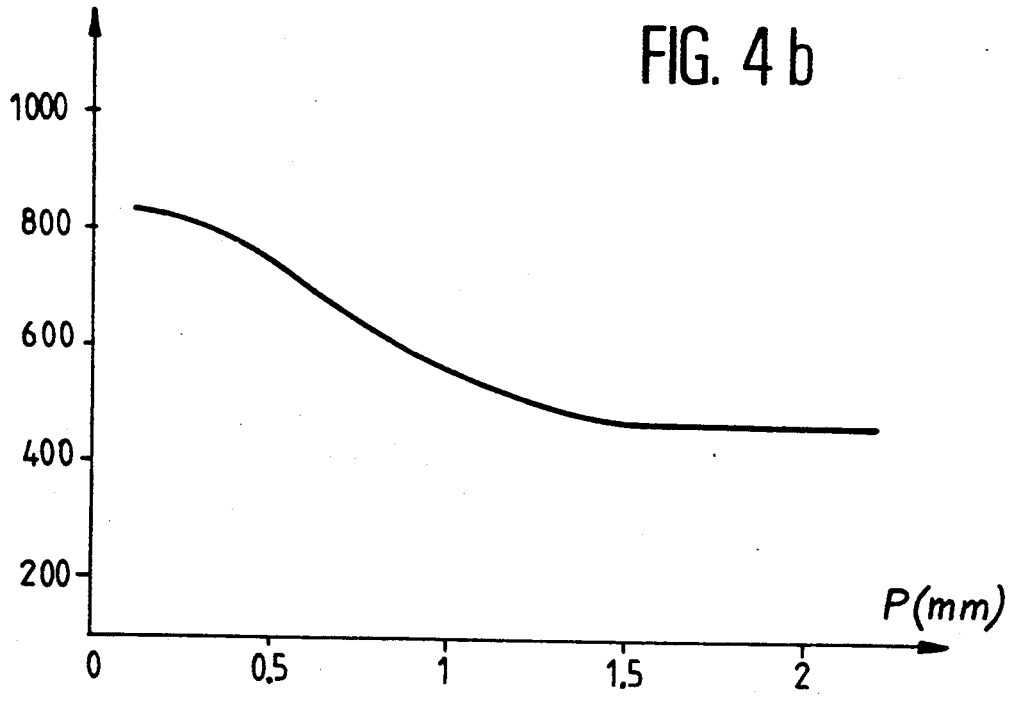
Figure 4C:
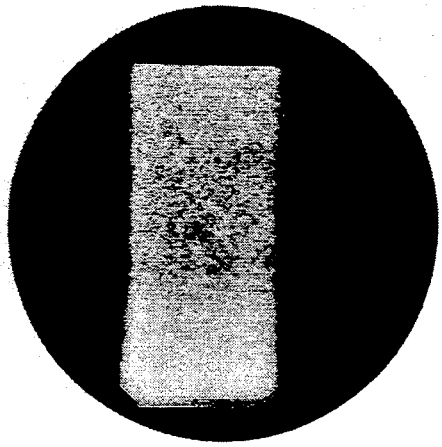
Figure 4D:
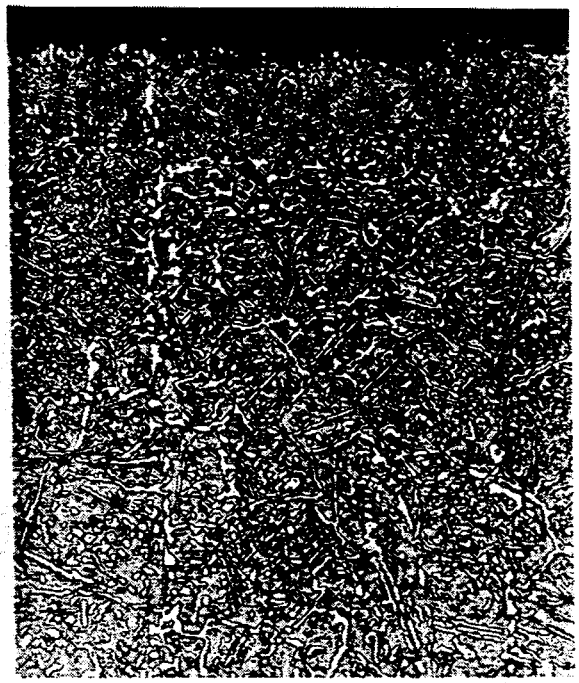
Figure 5A:
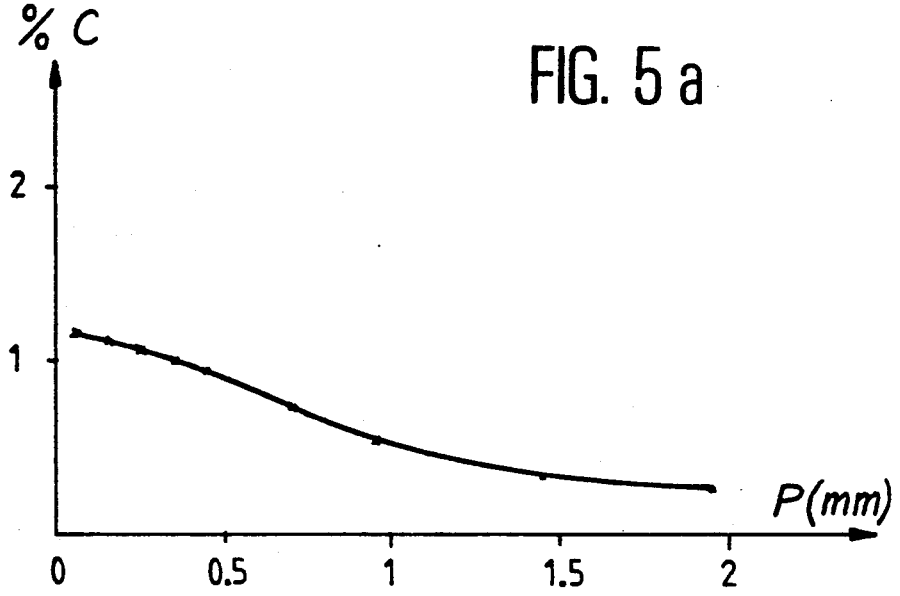
FIGS. 5*a*, 5*b*, 5*c* and 5*d* relate to example 5 concerning the carburization of Z 20 WC 10 steel parts.
Figure 5B:
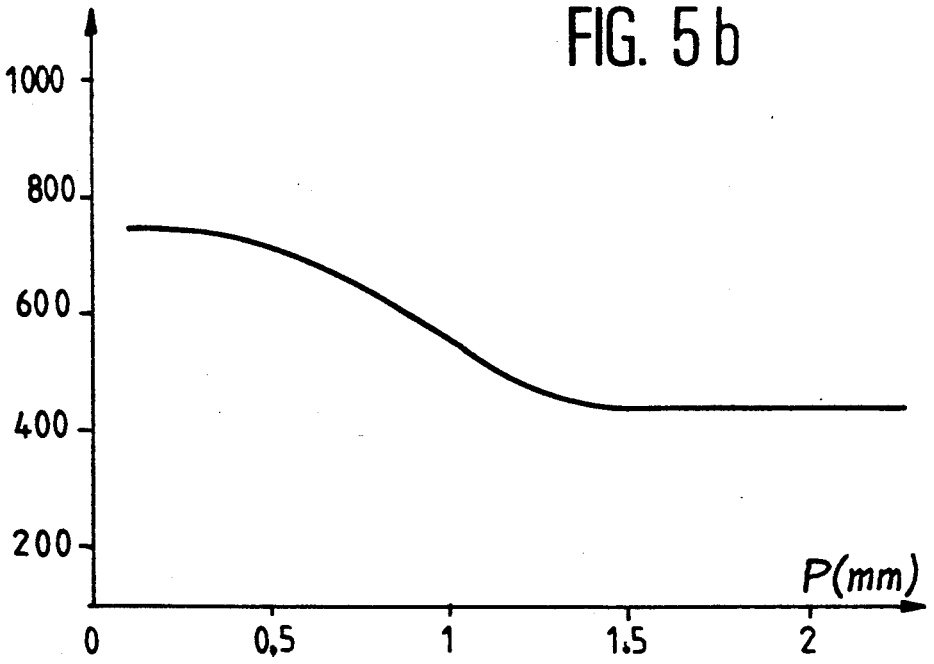
Figure 5C:
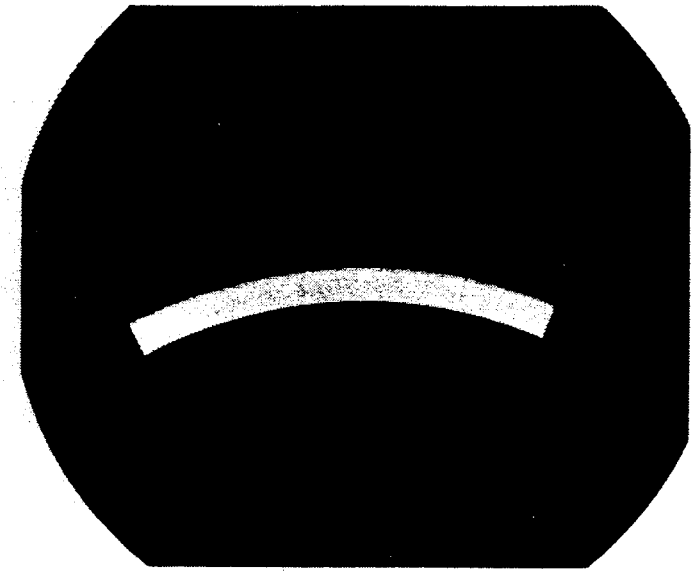
Figure 5D:
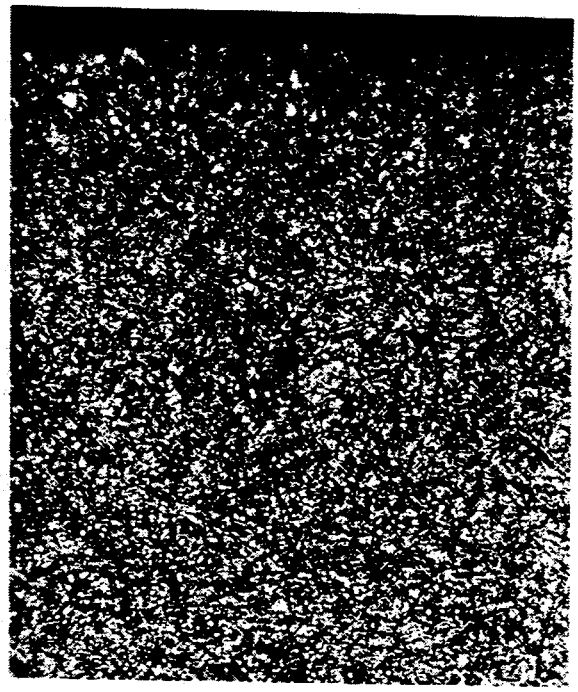
Figure 6A:
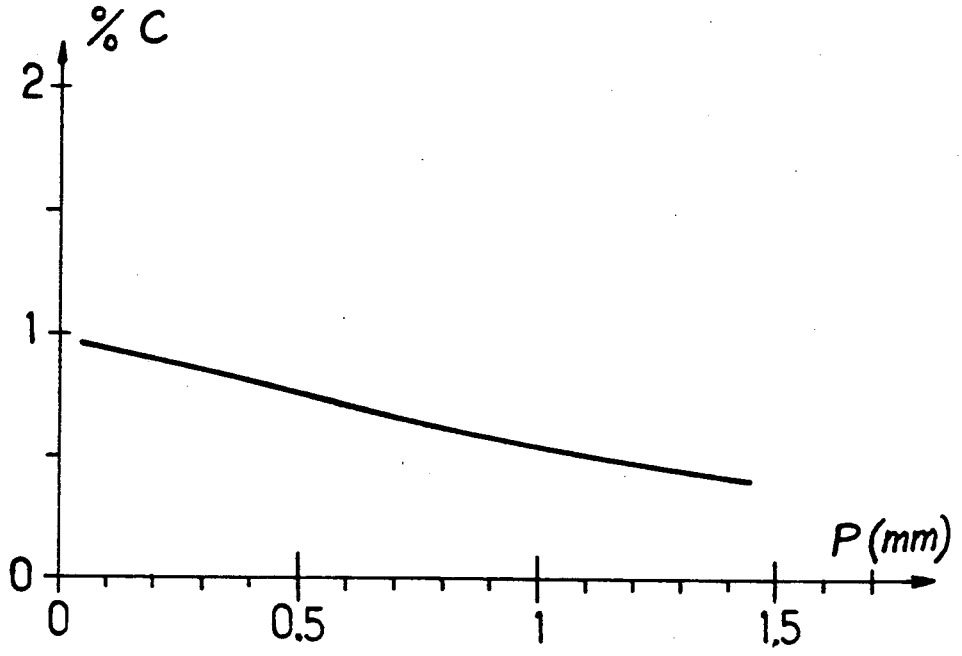
FIGS. 6*a*, 6*b*, 6*c* and 6*d* relate to example 6 concerning the carburization of Z 38 CDV 5 steel parts.
Figure 6B:
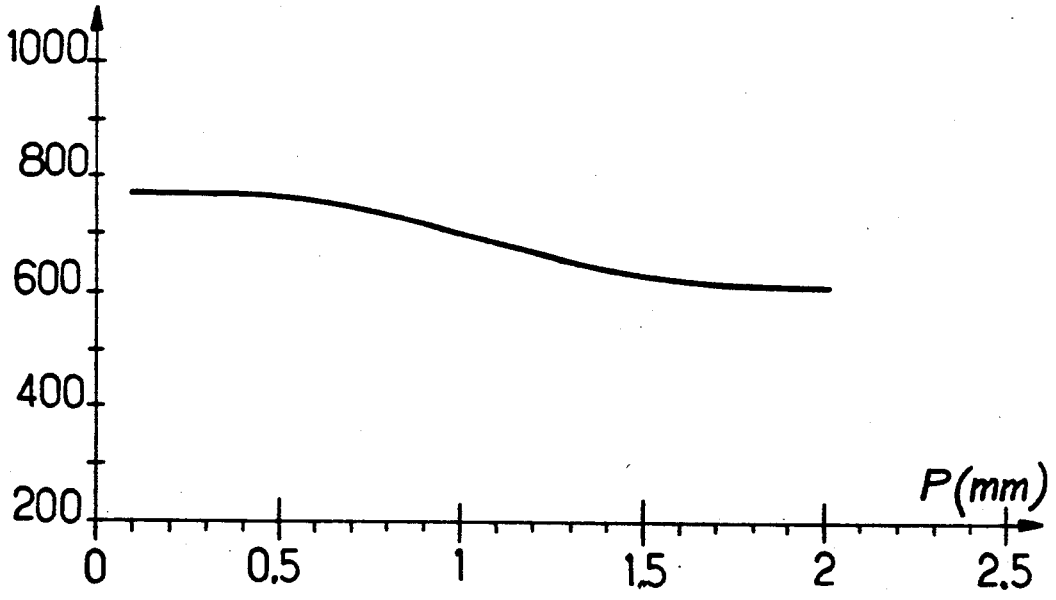
Figure 6C:
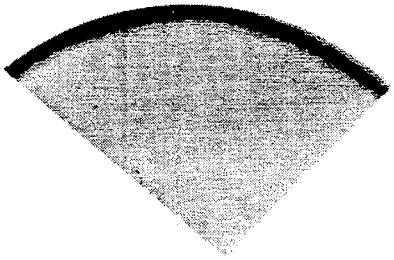
Figure 6D:
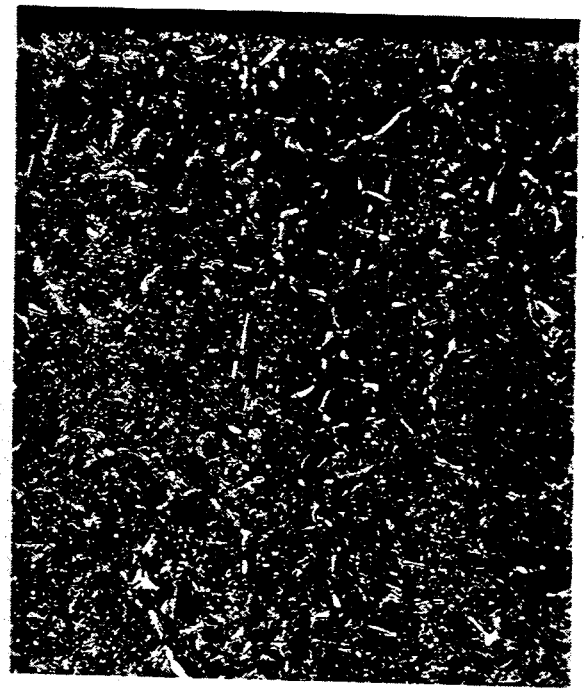

FIG. 2*d* is a section of a tubular part 20 carburized on its surface, periphery and in the bore according to example 2 after 2 % nital etching and respective magnification of 2 and 500 X showing the great regularity and homogeneity of the carburized layer.

Figure 8:
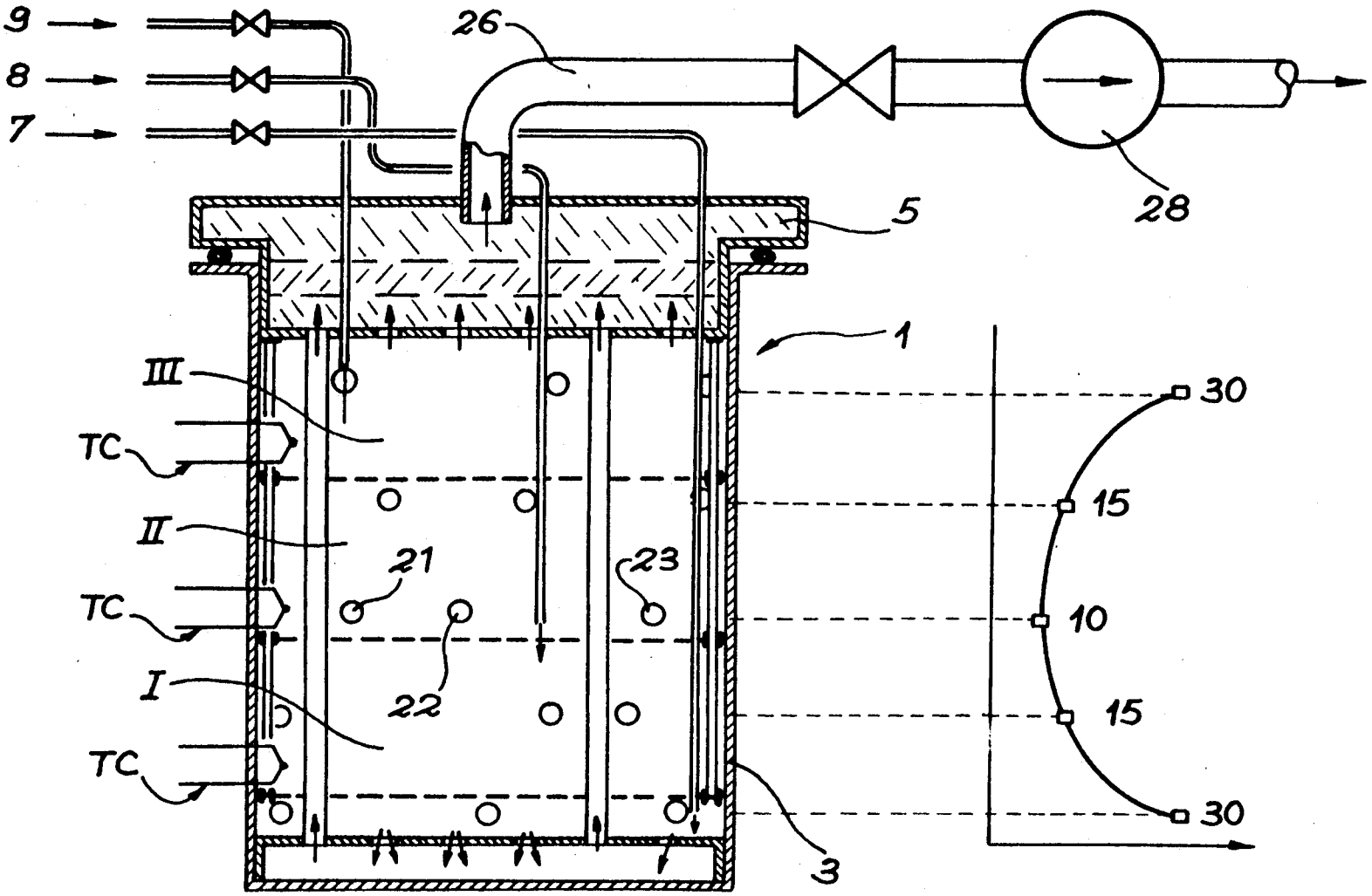
FIG. 8 the carburization vessel incorporating the device for circulating the fuel gas in the vessel.

FIG. 8 shows the vessel 3 and the internal device, together with the cover 5. Gas supply pipes 7, 8, 9 traverse the cover and respectively issue at the first I, second II and third III vessel stages at at least three outlets per stage which are regularly distributed in the manner of 21,22 and 23 for stage II in particular.

Thermocouples TC installed at each stage are permanently connected to a not shown microcomputer, which ensures that all the operations of the installation are correctly performed.

Each stage comprises a perforated plate on which rest the articles to be carburized. At their entry, the gases flow through the charge in the direction of the two outlets, the main one at the top of the vessel and the other branched off at the bottom of the vessel following the path indicated by the arrows, being finally sucked up at the top of the cover by a large pipe 26 connected to a circulating pump 28. A relative flow rate curve as a percentage of the carburizing gas is shown to the right of the furnace.

Figure 9:
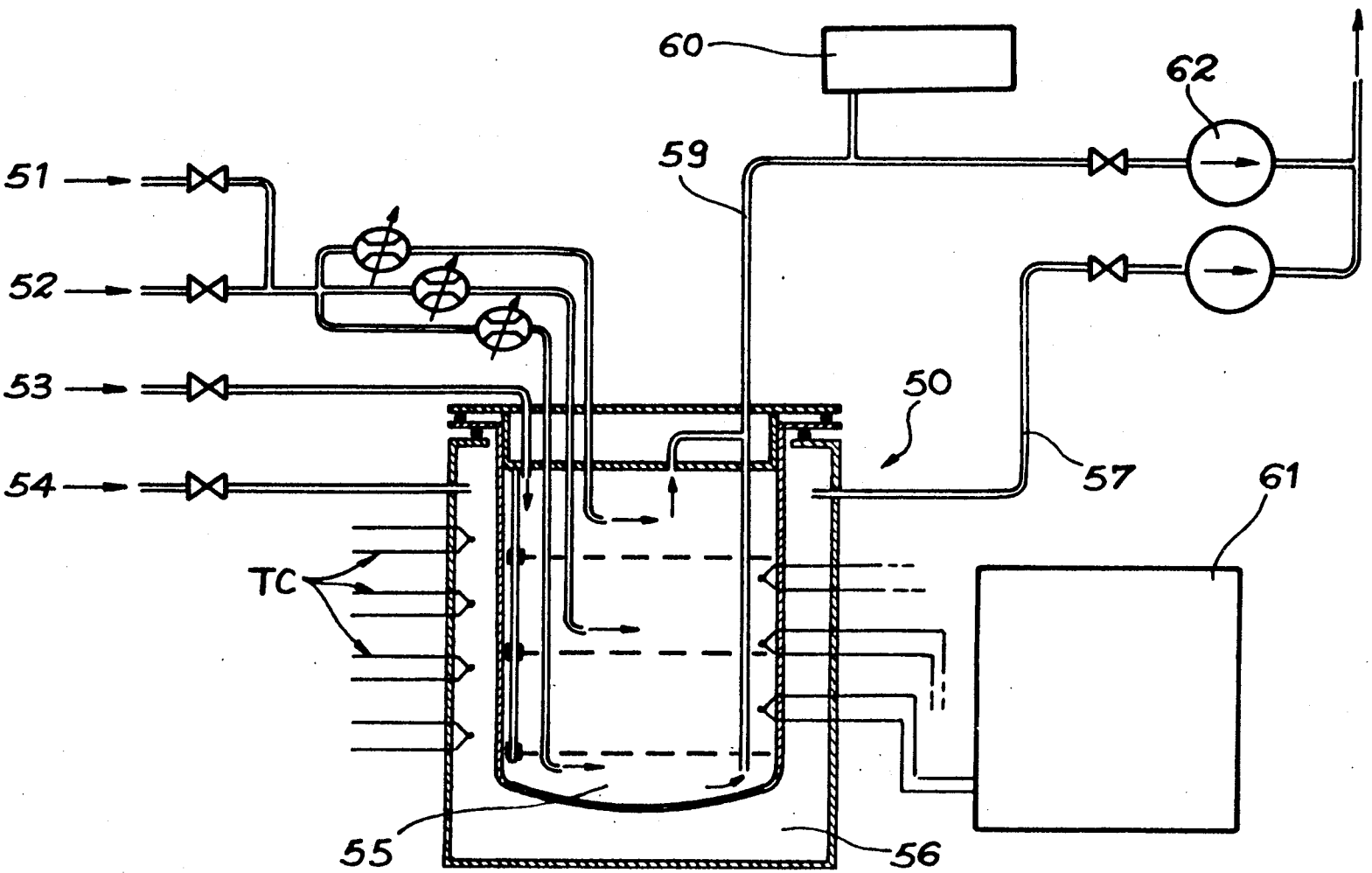
FIG. 9 a double vacuum (hot wall) carburization furnace.

The installation shown in FIG. 9 comprises a so-called double vacuum furnace 50 in the sense that the vacuum is established both in the vessel 55 and in the annular space 56 surrounding the vessel. The carburizing gases enter by pipes 51 for hydrogen and 52 for ethylene and are directed towards several stages, where they are regularly distributed. The circulation of the gases takes place in the vessel in the manner described in FIG. 8. The gases are then directed towards the pumping means 62 by a pipe 59 with a sample branched off to a gas analyser 60 linked with a microcomputer. Two other pipes 53 for nitrogen, as well as 54 and 57 for the air issue respectively at the top of the vessel 55 and the space 56. The data such as temperatures, pressure, flow rates and composition of the gases are collected by an acquisition means connected to a microcomputer 61.

Further to the details given in the various examples, the following information is provided. Before starting the treatments, air is eliminated from the vessel. This involves a preliminary vacuum formation at a pressure of $10^{-1}$ hPa and the vessel is filled with nitrogen purified at atmospheric pressure. The loading of the vessel containing the parts to be treated then takes place and the first austenitization phase is carried out by heating at different temperatures as a function of the particular case and with a maximum vacuum of $10^{-2}$ hPa.

The vacuum is broken by introducing hydrogen until a pressure of 500 hPa is obtained. Carbonization takes place by introducing ethylene at a pressure generally close to 30 hPa, followed by a diffusion at an absolute pressure equal to or below $10^{-1}$ hPa. The vacuum is then broken with nitrogen at atmospheric pressure and a use treatment is carried out, which makes it possible to obtain the final characteristics desired for the carburized parts. In the case of examples 4,5 and 6, following diffusion, the vacuum is broken with hydrogen and a second carbonization is carried out, followed by a diffusion, which precedes the breaking of the vacuum with nitrogen at atmospheric pressure.

The process is performed under the control of a microcomputer to which are supplied all the programmed technical parameters, such as the steel grades, the temperatures of the different points of the furnace, the pressure in the enclosure, the durations of the enrichment (carbonization) at diffusion sequences, the general flow rates of the gases at each stage, the composition of the gases and adjustments as a function of the analysis of the discharged gases.

We claim:

1. Process for the low pressure carburization of metal alloy parts contained in a furnace chamber heated to a temperature between about 820° C. and about 1100° C. comprising the steps of:

a) forming a preliminary vacuum in the chamber to a pressure of $10^{-1}$ hPa so as to eliminate the air, b) filling the chamber with purified nitrogen at atmospheric pressure, c) loading the metal parts into the chamber, d) forming a vacuum at $10^{-2}$ hPa in the chamber, e) heating the chamber to the austenitization temperature and maintaining this temperature for homogenizing the parts, f) introducing hydrogen into the chamber at a pressure of up to 500 hPa, g) introducing ethylene into the chamber at a pressure of 10 to 100 hPa and forming an ethylene-based fuel gas mixture with said hydrogen, said fuel gas mixture consisting of hydrogen and ethylene, ethylene being present in an amount of from about 2% to about 60% by volume for carbonization to provide carbon, h) vacuum diffusing carbon at $10^{-1}$ hPa, and i) introducing nitrogen into the chamber for unloading the parts.

2. Carburization process according to claim 1 in which the metal parts are of 16 NCD 13 steel and wherein:

step (e) includes vacuum austenitization for 30 minutes at 980° C., step (f) includes breaking the vacuum at 980° C. with hydrogen until a pressure of 500 hPa is reached, step (g) includes carbonization at 980° C. by the action of said ethylene-based fuel gas for 2 hours and at a pressure of 35 hPa, step (h) includes diffusion at 980° C. for 3½ hours at a pressure equal to or below $10^{-1}$ hPa, and step (i) includes breaking the vacuum with nitrogen at atmospheric pressure, followed by a use treatment of 825° C. and carburization is carried out over a depth of 1.80 mm, so as to obtain the desired carbon percentage as a function of the depth.

3. Carburization process according to claim 1, in which the metal parts are of 14 NCD 12 steel and wherein:

step (e) includes vacuum austenitization for 30 minutes at 880° C., step (f) includes breaking the vacuum with hydrogen at 880° C. until a pressure of 500 hPa is obtained, step (g) includes carbonization at 880° C. by the action of ethylene-based fuel gas for 85 minutes and at a pressure of 30 hPa, step (h) includes diffusion at 880° C. for 20 min. at a pressure equal to or below $10^{-1}$ hPa, and step (i) includes breaking the vacuum with nitrogen at atmospheric pressure, followed by a use treatment of 825° C. and carburization is carried out over a depth of 0.55 mm, while obtaining the desired carbon percentage as a function of the depth.

4. Carburization process according to claim 1, in which the metal parts are of Co:KC 20 WN-based superalloy, and wherein:

step (e) includes vacuum austenitization for 30 minutes at 1100° C., step (f) includes breaking the vacuum with hydrogen at 1100° C. until a pressure of 500 hPa is obtained, step (g) includes carbonization at 1100° C. by the action of said ethylene-based fuel gas for 4 hours and at a pressure of 40 hPa, step (h) includes diffusion at 1100° C. for 2 hours and a pressure equal to or below $10^{-1}$ hPa, and step (i) includes breaking the vacuum with nitrogen at atmospheric pressure, carburization being carried out over a total depth of 0.8 mm.

5. Process for the low pressure carburization of metal alloy parts contained in a furnace chamber heated to a temperature between about 820° C. and about 1000° C. comprising the steps of:

a) forming a preliminary vacuum in the chamber to a pressure of $10^{-1}$ hPa so as to eliminate the air, b) filling the chamber with purified nitrogen at atmospheric pressure, c) loading the metal parts into the chamber, d) forming a vacuum at $10^{-2}$ hPa in the chamber, e) heating the chamber to the austenitization temperature and maintaining this temperature for homogenizing the parts, f) introducing hydrogen into the chamber at a pressure of up to 500 hPa, g) introducing ethylene into the chamber at a pressure of 10 to 100 hPa, and forming an ethylene-based fuel gas mixture with said hydrogen, said fuel gas consisting of hydrogen and ethylene, ethylene being present in an amount of from about 2% to about 60% by volume for carbonization to provide carbon, h) vacuum diffusing carbon at $10^{-1}$ hPa, i) breaking the vacuum with hydrogen, j) introducing ethylene into the chamber at a pressure of 10 to 100 hPa, and forming more of said ethylene-based fuel gas for carbonization to provide carbon, k) diffusing carbon, and l) breaking the vacuum with nitrogen at atmospheric pressure.

6. Carburization process according to claim 5, in which the metal parts are of Z 15 CN 17.03 steel and wherein:

step (e) includes vacuum austenitization for 30 minutes at 1020° C. and then cooling in the furnace to 980° C., step (f) includes breaking the vacuum at 980° C. until a pressure of 500 hPa is obtained, step (g) includes carbonization at 980° C. by the action of said ethylene-based fuel gas for 45 minutes and at a pressure of 35 hPa, step (h) includes diffusion at 980° C. for 10 minutes and a pressure equal to or below $10^{-1}$ hPa, step (i) includes breaking the vacuum with hydrogen at 980° C. and at a pressure of 500 hPa, step (j) includes carbonization at 980° C. by the action of said ethylene-based fuel gas for $6\frac{3}{4}$ hours at a pressure of 35 hPa, step (k) includes diffusion at 980° C. for $4\frac{3}{4}$ hours and at a pressure equal to or below $10^{-1}$ hPa, and step (l) includes breaking the vacuum with nitrogen at atmospheric pressure, followed by a use treatment at 1020° C. and carburization is carried out over a depth of 1 mm giving the desired carbon percentage as a function of the depth.

7. Carburization process according to claim 5, in which the metal parts are of Z 38 CDV 5 steel and wherein:

step (e) includes austenitization for 30 minutes at 1010° C. and cooling in the furnace to 960° C., step (f) includes breaking the vacuum at 960° C. until a pressure of 500 hPa is obtained, step (g) includes carbonization at 960° C. by the action of ethylene-based fuel gas for 30 minutes and at a pressure of 30 hPa, step (h) includes diffusion at 960° C. for 10 minutes and a pressure equal to or below $10^{-1}$ hPa, step (i) includes breaking the vacuum with hydrogen at 960° C. until a pressure of 500 hPa, step (j) includes carbonization at 960° C. by the action of said ethylene-based fuel gas for 1 hour, step (k) includes diffusion at 960° C. at a pressure equal to or below $10^{-1}$ hPa, and step (l) includes breaking the vacuum with nitrogen at atmospheric pressure, followed by a use treatment at 990° C. and carburization is carried out over a depth of 1 mm while obtaining the desired carbon percentage as a function of the depth.

8. Process for the low pressure carburization of metal alloy parts contained in a furnace for heating in a furnace atmosphere comprising the steps of:

forming said furnace atmosphere of a gaseous fuel mixture consisting of hydrogen and ethylene at a pressure less than atmospheric pressure, ethylene being present in an amount of from about 2% to about 60% by volume for providing carbon for carburization of said metal alloy parts, heating said furnace atmosphere to a temperature of from about 820° C. to about 1100° C., and carburizing said metal alloy parts by incorporating carbon into the metal alloy parts to a desired depth.

9. Carburization process according to claim 8, in which the metal parts are of 16 NCD 13 steel comprising the steps of:

a) forming a preliminary vacuum in the furnace atmosphere to a pressure of $10^{-1}$ hPa so as to eliminate the air, b) filling the furnace atmosphere with purified nitrogen at atmospheric pressure, c) loading the metal parts into the furnace atmosphere, d) forming a vacuum at $10^{-2}$ hPa in the furnace atmosphere, e) heating the furnace atmosphere to provide vacuum austenitization at a temperature of 820° C. and maintaining this temperature for 30 minutes, f) introducing hydrogen into the furnace atmosphere at a temperature of 940° C. and a pressure of 500 hPa, g) introducing ethylene into the furnace atmosphere to form said ethylene-based fuel gas and carbonizing said fuel gas at a temperature of 940° C. and a pressure of 30 hPa for 45 minutes, h) vacuum diffusing carbon at 940° C. for 10 minutes and a pressure equal to or below $10^{-1}$ hPa, i) breaking the vacuum with hydrogen at 950° C. and to a pressure of 500 hPa, j) introducing ethylene into the chamber to form more of said ethylene-based fuel gas and carbonizing said fuel gas at 940° C. and a pressure of 35 hPa for 75 minutes, and k) breaking the vacuum with nitrogen at atmospheric pressure, followed by a use treatment of 1100° C. and carburization is carried out over a depth of 1 mm, giving the desired carbon percentage as a function of the depth.

10. Carburization process according to claim 8, in which the metal parts are of Z 20 WC 10 steel comprising the steps of:

a) forming a preliminary vacuum in the furnace atmosphere to a pressure of $10^{-1}$ hPa so as to eliminate the air, b) filling the furnace atmosphere with purified nitrogen at atmospheric pressure, c) loading the metal parts into the furnace atmosphere, d) forming a vacuum at $10^{-2}$ hPa in the furnace atmosphere, e) heating the furnace atmosphere to provide austenitization at a temperature of 1010° C. and maintaining this temperature for 30 minutes, f) introducing hydrogen into the furnace atmosphere at a temperature of 820° C. and a pressure of 500 hPa, g) introducing ethylene into the furnace atmosphere to form said ethylene-based fuel gas and carbonizing said fuel gas at a temperature of 820° C. and a pressure of 25 hPa for 1 hour, h) introducing nitrogen into the furnace atmosphere at atmospheric pressure, followed by a use treatment of 820° C. and carburization is carried out over a depth of 0.25 mm, while obtaining the desired carbon percentage as a function of the depth.

* * * * *